US006182596B1

(12) United States Patent
Johnson

(10) Patent No.: US 6,182,596 B1
(45) Date of Patent: Feb. 6, 2001

(54) SYSTEM FOR MINIMIZING THE EFFECTS OF SHOCK AND VIBRATION IN A HIGH SPEED VESSEL

(76) Inventor: Robert K. Johnson, 10733 Spring St., Largo, FL (US) 33774-4338

( * ) Notice: Under 35 U.S.C. 154(b), the term of this patent shall be extended for 0 days.

(21) Appl. No.: 09/517,920

(22) Filed: Mar. 3, 2000

(51) Int. Cl.[7] ..... B63B 1/22
(52) U.S. Cl. ..... 114/284; 114/279
(58) Field of Search ..... 114/343, 61.1, 114/56.1, 61.32, 271, 274, 279, 284, 285

(56) References Cited

U.S. PATENT DOCUMENTS

| | | | | |
|---|---|---|---|---|
| 1,104,745 | | 7/1914 | Gunnarson . | |
| 1,136,711 | | 4/1915 | Paulauski . | |
| 1,265,035 | * | 5/1918 | Bazaine | 114/284 |
| 1,792,745 | | 2/1931 | Kasarinoff . | |
| 2,617,377 | | 11/1952 | Evans . | |
| 3,207,112 | | 9/1965 | Fox . | |
| 3,270,701 | | 9/1966 | Kubas . | |
| 4,337,715 | | 7/1982 | de Pignon . | |
| 4,351,262 | | 9/1982 | Matthews . | |
| 5,465,678 | * | 11/1995 | Ekman | 114/284 |
| 5,647,296 | * | 7/1997 | Pasanen | 114/279 |
| 6,003,465 | * | 12/1999 | Khachatrian et al. | 114/284 |

* cited by examiner

*Primary Examiner*—Stephen Avila
(74) *Attorney, Agent, or Firm*—Dennis G. LaPointe; Mason & Associates, PA

(57) ABSTRACT

A system for minimizing the effects of shock and vibration in a high speed vessel with an inner hull and an outer hull. It is a system of dampers, springs and stabilizer linkages in a high speed vessel that control the relative motion of an inner hull to an outer hull, thereby minimizing the effects of shock and vibration in the inner hull. Leaf spring assemblies may be used or as a substitute, torsion rod assemblies may be used, both in combination with dampers such as shock absorbers.

30 Claims, 10 Drawing Sheets

SYSTEM FOR MINIMIZING THE EFFECTS OF SHOCK AND VIBRATION IN A HIGH SPEED VESSEL

BACKGROUND OF THE INVENTION

1. Field of the Invention

The invention relates to a system of dampers, springs and stabilizer linkages in a high speed vessel that control the relative motion of an inner hull to an outer hull, thereby minimizing the effects of shock and vibration in the inner hull.

2. Description of Related Art

Shock cushioning systems for decks and cargo platform are known in the art. However, they generally lack motion control and do not incorporate a double hull system. Nor are these systems designed to be used in a high speed boat or vessel such as a racing boat or what is commonly known by the populace as a cigarette boat.

Known related art includes a stabilized watercraft for minimizing pitching and wave shock of small craft depicted in U.S. Pat. No. 3,270,701 to Kubas. This invention lacks a double hull safety feature and the forward portion of the bottom is rigidly attached to the bow diminishing the cushioning action where it is most needed in speed boats. Further, there is no positive attachment aft and no motion control utilizing stabilizer linkages as in the present invention. Another related art is a shock cushioned load platform depicted in U.S. Pat. No. 3,207,112 to Fox. Again, this system does not have a double hull feature and guides with balls are used to control sliding motion. Further, the coil springs are compression springs, not springs that work in tension and compression. In addition, the steel springs corrode with salt water exposure. The lack of dampers also severely limit motion control. U.S. Pat. No. 1,104,745 to Gunnarson and U.S. Pat. No. 1,136,711 to Paulauski disclose transverse or side-to-side cushioning only. No vertical cushioning is provided and such a system is applicable only to provided bumper means for low speed watercraft, such as protection from docks. Other known related system that provide for minimal cushioning or are limited to preventing rolling and pitching in a single hull vessel include U.S. Pat. No. 1,792,745 to Kasarinoff, U.S. Pat. No. 2,617,377 to Evans, and U.S. Pat. No. 4,351,262 to Matthews.

None of the devices in the above references solve the problem of providing a combination of linkages, dampers and load distribution springs between an inner and an outer hull of a speed boat. Speed boat operators and passengers are notoriously subject to serious rib, arm and leg injuries from the jarring effects of pounding the rough seas during a race or a high speed run. An object of the present invention would provide a system which controls the motion of the inner hull relative to the motion of the outer hull, thereby providing a safer environment for the operator or passengers in a high speed vessel. This novel system will allow higher attainable speeds within the bounds of human tolerance and otherwise will provide for a more comfortable ride.

SUMMARY OF THE INVENTION

The present invention is a system for minimizing the effects of shock and vibration in a high speed vessel and comprises a vessel having an inner hull and an outer hull. The inner hull includes a deck, superstructure, ship propulsion machinery, tankage and related equipment, including vessel controls and navigational equipment.

The inner hull superstructure has a side deck and a downwardly extending outer edge along a perimeter of the superstructure side deck. The side deck and outer edge are in an overlapping relationship with a corresponding deck flange and downwardly extending outer edge along a perimeter of an upper edge of a sidewall of the outer hull.

The outer hull of the vessel is typically designed for high speed maneuverability and is generally watertight or non-flooding. It is also preferable that the inner hull also have watertight integrity.

The invention includes at least one longitudinal pivoted link, one end of which is pivotally attached at a predetermined location on an inner bottom surface of the outer hull and generally aft of the vessel. An opposite end is pivotally attached at a predetermined location on an outer surface of the inner hull and generally forward of the vessel proximate a keel line of the vessel. The longitudinal pivoted link constrains the longitudinal motion of the inner hull relative to the outer hull while allowing relative vertical motion.

An aft transverse pivoted link is also included with one end being pivotally attached generally under the outer bottom surface of the inner hull at a location generally aft of the vessel and proximate a joinder of an inner sidewall surface of the outer hull and an inner bottom surface of the outer hull. The opposite end is pivotally attached at a predetermined location on the outer bottom surface of the inner hull proximate a joinder of an outer sidewall of the inner hull and the bottom surface of the inner hull. The aft transverse pivoted link constrains the lateral motion of the inner hull relative to the outer hull while allowing relative vertical motion.

A forward end lateral motion limiting means is incorporated between a bow end of the inner hull and a bow end of the outer hull for providing a lateral motion constraint while allowing relative vertical motion.

In a practical application of the incorporation of the forward end lateral motion limiting means, a vertically oriented attachment plate is integrally fixed at a predetermined location along a centerline of the bow end of the inner hull. The attachment plate includes a vertically oriented slot extending from a bottom surface of an edge of the attachment plate upwardly a distance corresponding to a predetermined travel limit. A transverse oriented member is symmetrically and integrally fixed at each end thereof to a corresponding location on the inner sidewall surface of the outer hull juxtaposed a centerline of the bow end of the outer hull. The transverse oriented member is aligned to be received within the slot of the attachment plate. In order to limit lateral or transverse motion of the bow end of the inner hull relative to the bow end of the outer hull when the transverse oriented member is engaged within the slot, the transverse oriented member may have oversized portions on either side of the slotted attachment plate. The oversized portions are preferably made of low friction material. It is further recommended that the oversized portions be rolling devices, that is, wheels or ball bearings. Alternatively, the oversized portions may be integral extended portions of the transverse oriented member.

The invention further includes a plurality of spring and damper support means between the inner hull and outer hull for cushioning a vertical motion imparted by the outer hull. Each of the plurality of spring and damper support means are typically located symmetrically at predetermined locations along a port and starboard side of the vessel.

A flexible spray shield is recommended to block a spray of water from entering between the inner hull and the outer hull through a clearance where the inner hull superstructure side deck and outer edge overlap the corresponding deck flange and outer edge of the outer hull. The spray shield is adapted to maintain a water spray shielding effect during the movement corresponding to the relative motion between the inner and outer hulls.

In lieu of having longitudinal pivoted link(s) running in an orientation essentially along the keel line of the vessel between the inner hull and the outer hull, an alternative configuration is two longitudinal pivoted links which are pivotally attached so as to form a generally V-shaped configuration. In this configuration, one end of each longitudinal pivoted link is pivotally attached on the inner bottom surface of the outer hull generally aft of the vessel and proximate the joinder of the inner sidewall surface of the outer hull and the inner bottom surface of the outer hull, and generally symmetric to the keel line with each opposite end of the longitudinal pivoted link being pivotally attached at the predetermined location on the outer surface of the inner hull generally forward of the vessel proximate the keel line of the vessel.

A plurality of rubber bumpers, each fixed at predetermined locations along the deck flange of the outer hull, are included for limiting compression between and preventing direct contact of the superstructure side deck and the outer hull deck flange.

In one embodiment, each spring and damper support means is located between the inner hull superstructure side deck and a structural attachment member integrally fixed to and extending from the inner sidewall surface of the outer hull. The structural attachment member is typically a bulkhead member or gusset member integrally attached to the outer hull with the necessary brackets to attach the spring and damper support means components.

In a practical application of this embodiment of the spring and damper support means, included components are a flexible leaf spring member of a predetermined length and oriented generally in the same direction of the side deck above the leaf spring member. The leaf spring member is attached at an approximate midpoint to the structural attachment member integrally fixed to and extending from the inner sidewall surface of the outer hull. The leaf spring member is also attached to the side deck with two adjustable links, each on opposite sides of the midpoint attachment at a point a predetermined distance from the midpoint attachment. The links are pivotally connected and communicating with an attachment fixed to the side deck.

To provide for a dampening effect, damper support means are also included with one end being attached to the structural attachment member fixed to and extending from the inner sidewall surface of the outer hull and an opposite end being attached to the side deck. There are several methods known in the art regarding the attachment means, including associated brackets and pin connections.

The adjustable links for the leaf spring member may be adjusted for softening or stiffening a vessel ride by changing a rate of response to loads on the outer hull. This is typically done by moving the attachment points on the leaf spring member away or closer to the midpoint. Depending on the size of the vessel, it may be advantageous to locate at least one of the plurality of spring and damper support means at predetermined locations along the stern of the vessel.

In lieu of a leaf spring member, in another practical application of the invention, a torsion bar assembly may be used. In this embodiment, the spring and damper support means would include a torsion rod. In one embodiment, the torsion rod is fixedly attached at one end to the outer sidewall of the inner hull. In addition, the torsion rod has a bearing support at a predetermined distance from an active end of the torsion rod. The bearing support is attached to the outer sidewall of the inner hull and the torsion rod is aligned generally parallel to the side deck. Typically, end of the torsion rod is relatively fixed. This can be done with a spline end within the support at the end of the torsion rod. The bearing support allows the torsion rod to rotate or twist at its active end.

As such, the torsion rod further includes a lever, one end of which is fixed to the active end. A generally downward directed link is connected at one end to a desired adjusted location on the lever for providing spring rate adjustment, and an opposite end of the link is attached to the inner sidewall surface of the outer hull. Of course, the mirror reverse arrangement is foreseeable where the attachments for the torsion rod and the downward directed link are reversed so that the torsion rod attachments, that is, the support end and the bearing support, are on the inner sidewall surface of the outer hull and the downward link is attached to the outer sidewall surface of the inner hull.

Of course, damper support means are preferably used in conjunction with the torsion bar assembly. Typically, one end of the damper support means, usually a shock absorber, is attached to the structural attachment member fixed to and extending from the inner sidewall surface of the outer hull and an opposite end is attached to the side deck.

Access holes may have to be provided in the inner hull to assist in the installation of the various linkages and damper means described above during the manufacturing process of the vessel or for maintenance purposes. In circumstances where it may not be practical to manually open an access hole, it is anticipated that electronic/mechanical means will be provided to remotely adjust the hardness or softness of the ride from an operator console.

Further, the damper support means may include electronic/mechanical activation means to provide for an active suspension that responds to loads on the outer hull, that is, sensors feeling the impact of the wave shock can automatically respond to the resultant loads by adjusting the shock absorber stiffness. This works well with pneumatically or hydraulically controlled shock absorbers. Of course, the damper support means may also be manually adjusted to adjust ride stiffness.

Similarly, each leaf spring member may include electronic/mechanical activation means for selectively adjusting the hardness of the ride by spreading the links toward and away from the proximate midpoint attachment. In one embodiment, this may typically be done with appropriate jack screws and trunnion assemblies operated by electronic controls.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
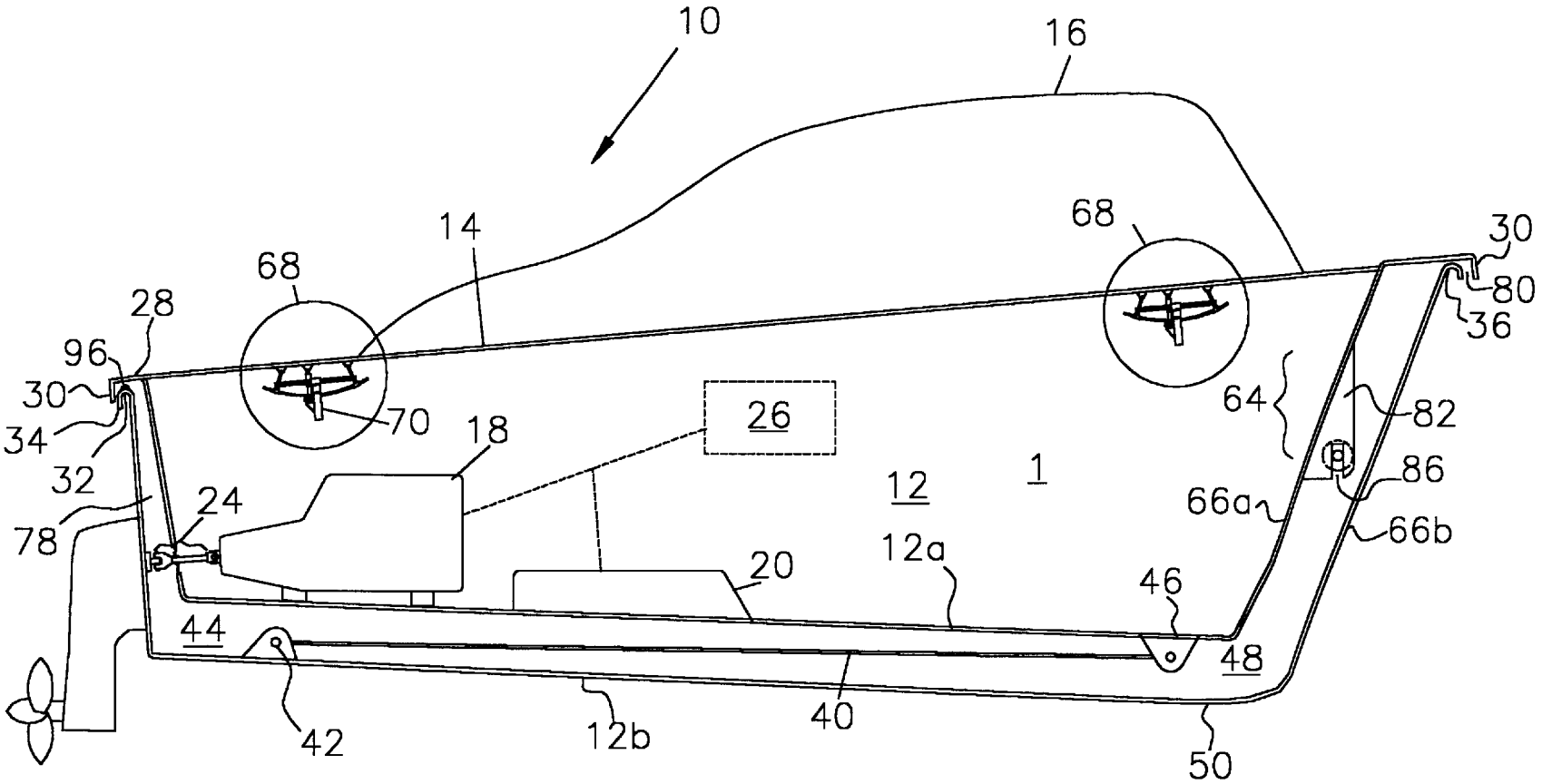
FIG. 1 is a schematic diagram of the invention.

Referring now to the drawings, in particular FIG. 1, the invention which is a system for minimizing the effects of shock and vibration in a high speed vessel and is depicted generally as 10, comprises a vessel 12 having an inner hull 12*a* and an outer hull 12*b*. The inner hull 12*a* includes a deck 14, superstructure 16, ship propulsion machinery 18, tankage 20 and related equipment 26, such as vessel controls and navigational equipment.

The inner hull superstructure 16 has a side deck 28 and a downwardly extending outer edge 30 along a perimeter of the superstructure side deck 28. The side deck 28 and outer edge 30 are in an overlapping relationship with a corresponding deck flange 32 and downwardly extending outer edge 34 along a perimeter of an upper edge 36 of a sidewall 38 of the outer hull 12*b*.

The outer hull 12*b* of the vessel 12 is typically designed for high speed maneuverability and is generally watertight or non-flooding, that is, intact. It is also preferable that the inner hull 12*a* have watertight integrity. The propulsion machinery 18 which would include a motor and outdrive extending through the stern 78 of the inner hull 12*a* through the stern 78 of the outer hull 12*b*. Typically the shaft 24 would be hinged, have a universal joint and include flexible seals that would maintain hull integrity, typical of inboard/outboard drive shafts associated with high performance engines, including water jet propulsion systems.

In addition, it is anticipated that the inner hull 12*a* would have venting incorporated into needed areas of the engine compartment as well as in areas needed to vent off air and gases that may build up between the inner hull 12*a* and the outer hull 12*b*. Methods of providing such venting of air gases are known in the art. Further, it is also understood that appropriate drain methods would be incorporated in the vessel 12 to ensure that any water that may enter a bilge area of the inner hull 12*a* or in the bilge or bottom surface 42 of the outer hull 12*b* be directed outside the vessel 12 by using a bilge or sump pump, by a gravity drain or siphoning effect, or by using a combination of such methods.

As depicted in FIG. 1, the invention includes at least one longitudinal pivoted link 40, one end of which is pivotally attached at a predetermined location on an inner bottom surface 42 of the outer hull 12*b* and generally aft 44 of the vessel 12. An opposite end is pivotally attached at a predetermined location on an outer surface 46 of the inner hull 12*a* and generally forward 48 of the vessel 12 proximate a keel line 50 of the vessel 12. The longitudinal pivoted link 40 constrains the longitudinal motion of the inner hull 12*a* relative to the outer hull 12*b* while allowing relative vertical motion.

Figure 6:
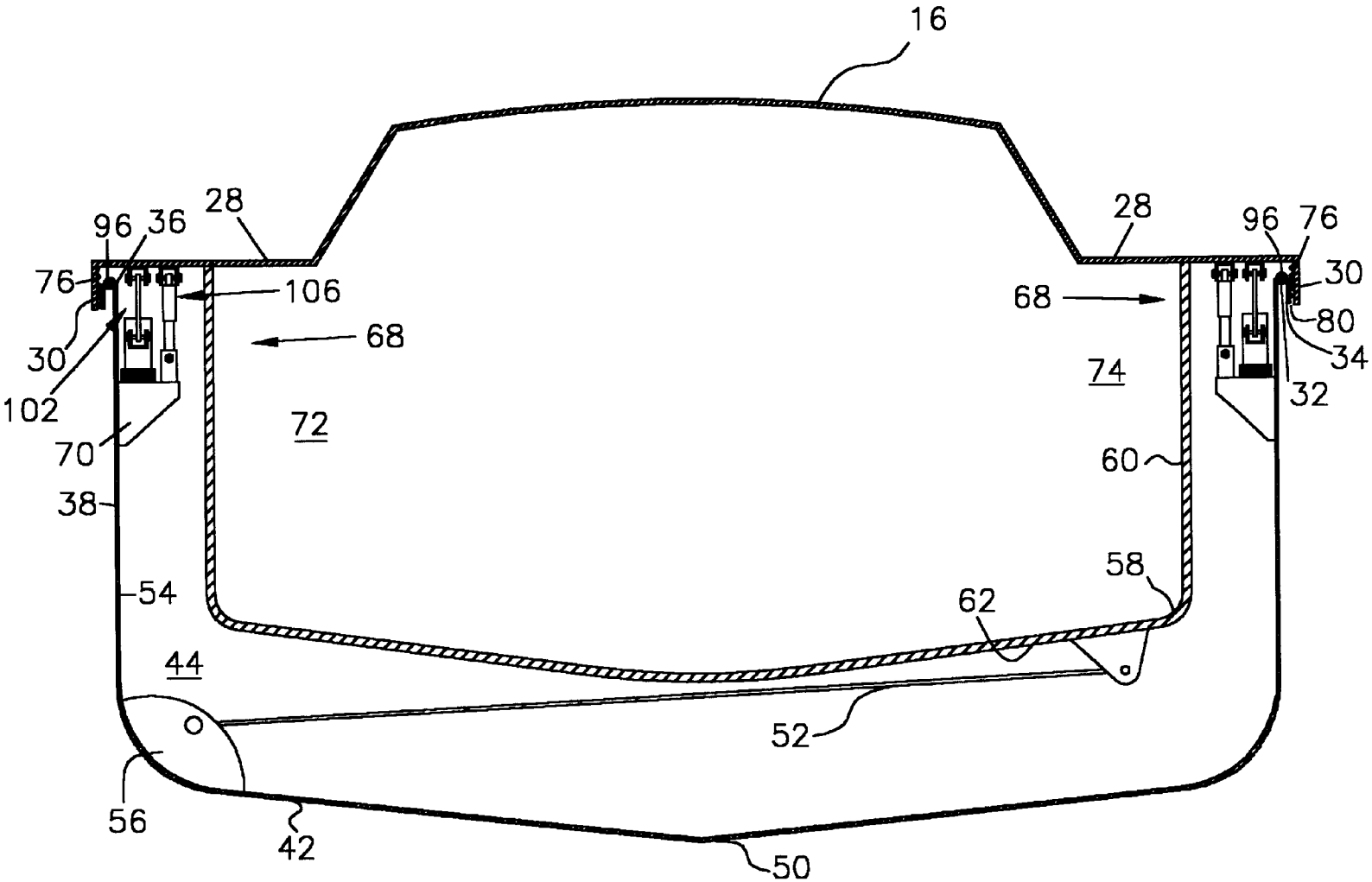
FIG. 6 is a schematic diagram depiction the invention from an aft view.

As depicted in FIG. 6, an aft transverse pivoted link 52 is also included with one end being pivotally attached generally under the outer bottom surface 62 of the inner hull at a location generally aft 44 of the vessel 12 and proximate a joinder 56 of an inner sidewall surface 54 of the outer hull 12*b* and an inner bottom surface 42 of the outer hull 12*b*. The opposite end is pivotally attached at a predetermined location on the outer bottom surface 62 of the inner hull 12*a* proximate a joinder 58 of an outer sidewall 60 of the inner hull 12*a* and the bottom surface 62 of the inner hull 12*a*. The aft transverse pivoted link 52 constrains the lateral motion of the inner hull 12*a* relative to the outer hull 12*b* while allowing relative vertical motion.

Figure 4:
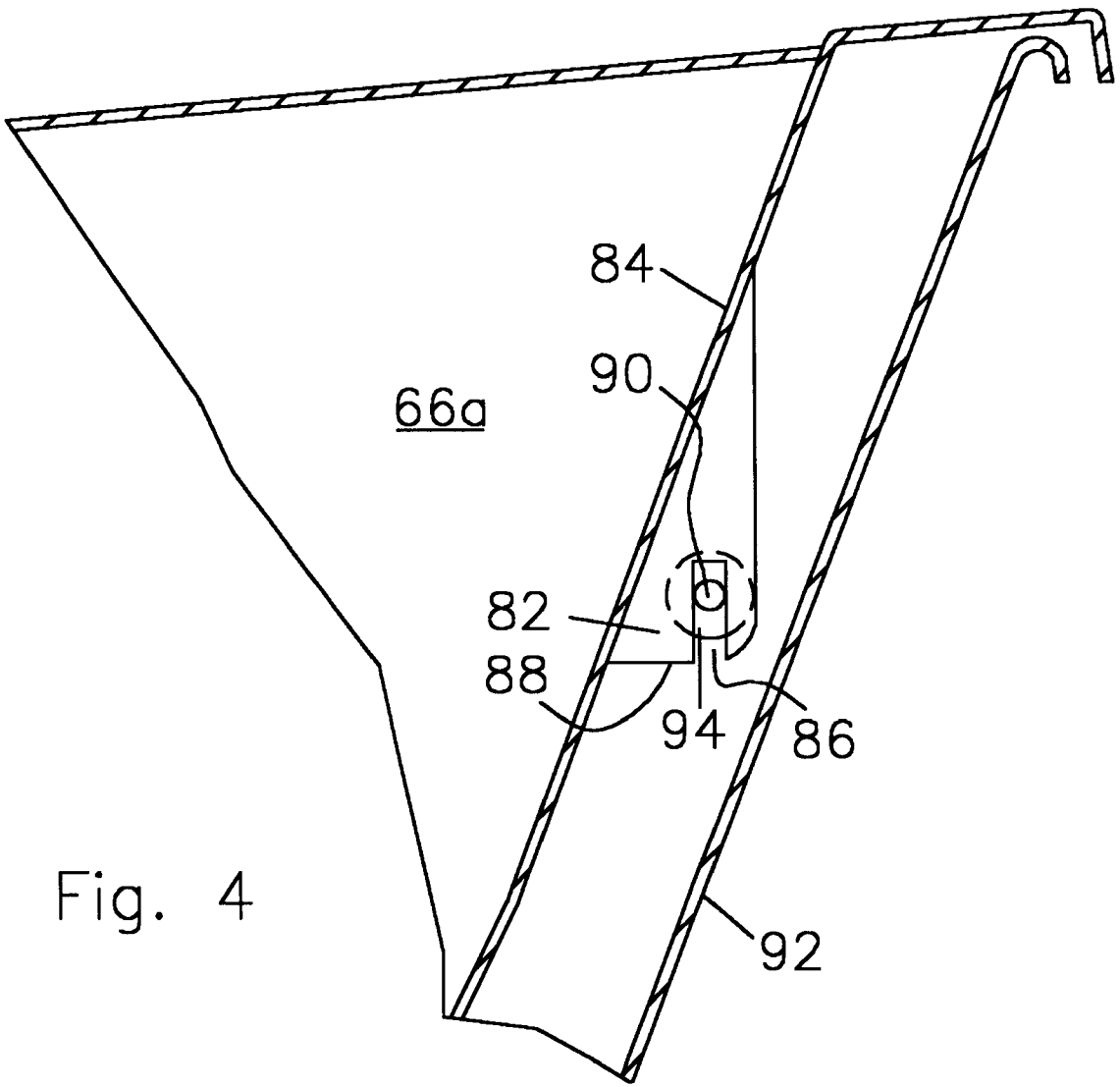
FIG. 4 is a practical application depiction of a portion of the forward end lateral motion limiting means of the present invention.
Figure 5:
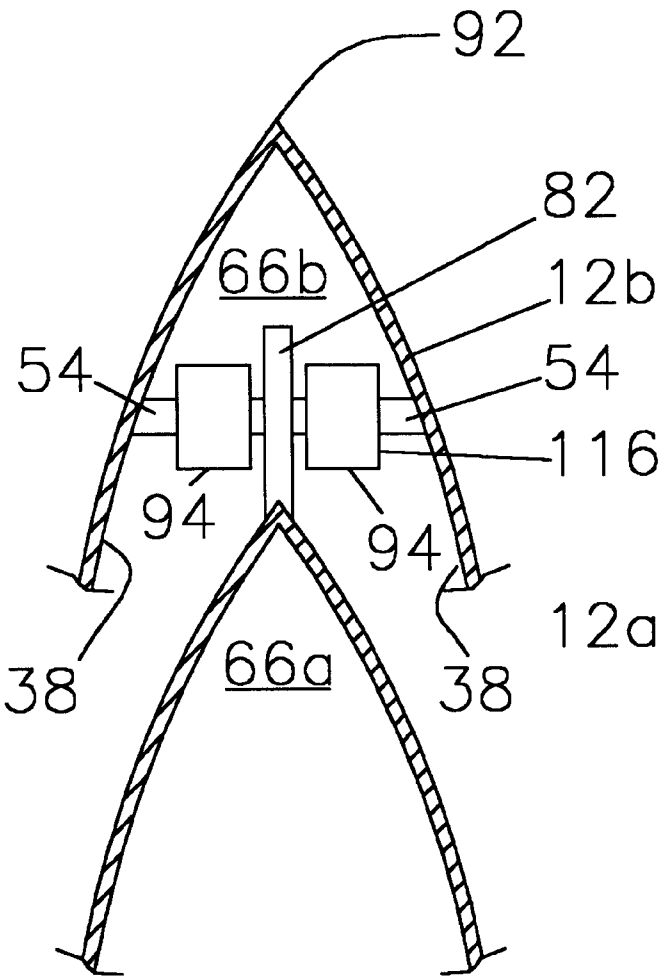
FIG. 5 is a plan view of the forward end lateral motion means of FIG. 4.

Referring to FIGS. 1, 4 and 5, a forward end lateral motion limiting means 64 is incorporated between a bow end 66*a* of the inner hull 12*a* and a bow end 66*b* of the outer hull 12*b* for providing a lateral motion constraint while allowing relative vertical motion.

There are several different methods known in the art on how a boat builder may structure the forward end lateral motion limiting means 64. In one suggested practical application of the incorporation of the forward end lateral motion limiting means 64, a vertically oriented attachment plate 82 is integrally fixed at a predetermined location along a centerline 84 of the bow end 66*a* of the inner hull 12*a*. The attachment plate 82 includes a vertically oriented slot 86 extending from a bottom surface of an edge 88 of the attachment plate 82 upwardly a distance corresponding to a predetermined travel limit. A transverse oriented member 90 is symmetrically and integrally fixed at each end thereof to a corresponding location on the inner sidewall surface 38 of the outer hull 12*b* juxtaposed a centerline 92 of the bow end 66*b* of the outer hull 12*b*. The transverse oriented member 90 is aligned to be received within the slot 86 of the attachment plate 82. In order to limit lateral or transverse motion of the bow end 66*a* of the inner hull 12*a* relative to the bow end 66*b* of the outer hull 12*b* when the transverse oriented member 90 is engaged within the slot 86, the transverse oriented member 90 may have oversized portions 94 on either side of the slotted attachment plate 82. The oversized portions 94 are preferably made of low friction material. Although the components of the forward end lateral motion limiting means 64 may be made of other materials known in the art, suggested materials are non-corrosive materials or corrosion-resistant materials such as fiber-reinforced composite polymer material, polymeric material, coated steel alloys, non-corrosive metals, graphite composition material and combinations thereof. It is further recommended that the oversized portions 94 be rolling devices 116, that is, wheels or ball bearings. Alternatively, the oversized portions 94 may be integral extended portions of the transverse oriented member 90.

As generally depicted in FIG. 1 but more particularly depicted in FIGS. 2, 3, 6 and 8, the invention 10 further includes a plurality of spring and damper support means 68 between the inner hull 12*a* and outer hull 12*b* for cushioning a vertical motion imparted by the outer hull 12*b*. Each of the plurality of spring and damper support means 68 are typically located symmetrically at predetermined locations along a port 72 and starboard 74 side of the vessel 12.

A flexible spray shield 76 is recommended to block a spray of water from entering between the inner hull 12*a* and the outer hull 12*b* through a clearance 80 where the inner hull 12*a* superstructure side deck 28 and outer edge 30 overlap the corresponding deck flange 32 and outer edge 34 of the outer hull 12*b*. The spray shield 76 is adapted to maintain a water spray shielding effect during movement corresponding to the relative motion between the inner and outer hulls 12*a*,12*b*.

The flexible spray shield 76 is typically made from a elastomer material, a polymeric material, or combinations thereof. A practical application would be to use a folded elastomer as depicted in the drawings; however, a manufacturer need only provide sufficient slack to maintain the desired water spray shielding effect between the inner hull 12*a* and the outer hull 12*b*.

Figure 7:
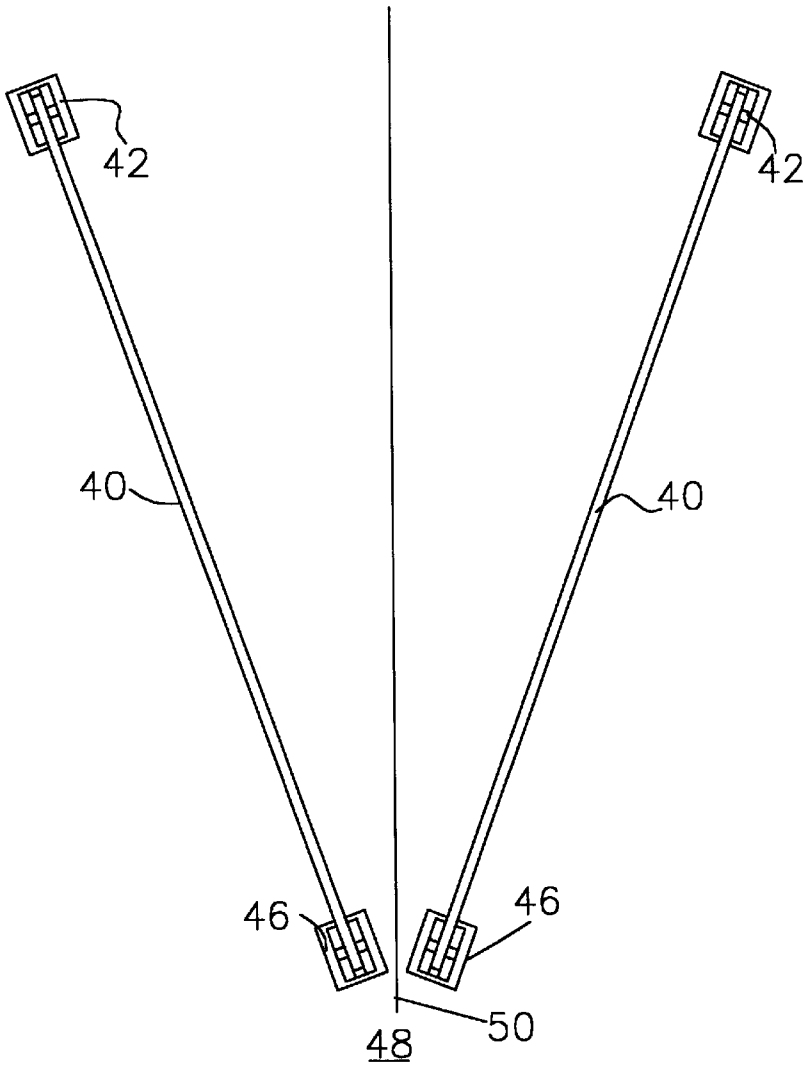
FIG. 7 is a practical application of the use of longitudinal pivoted links in a V-shape configuration.
Figure 8:
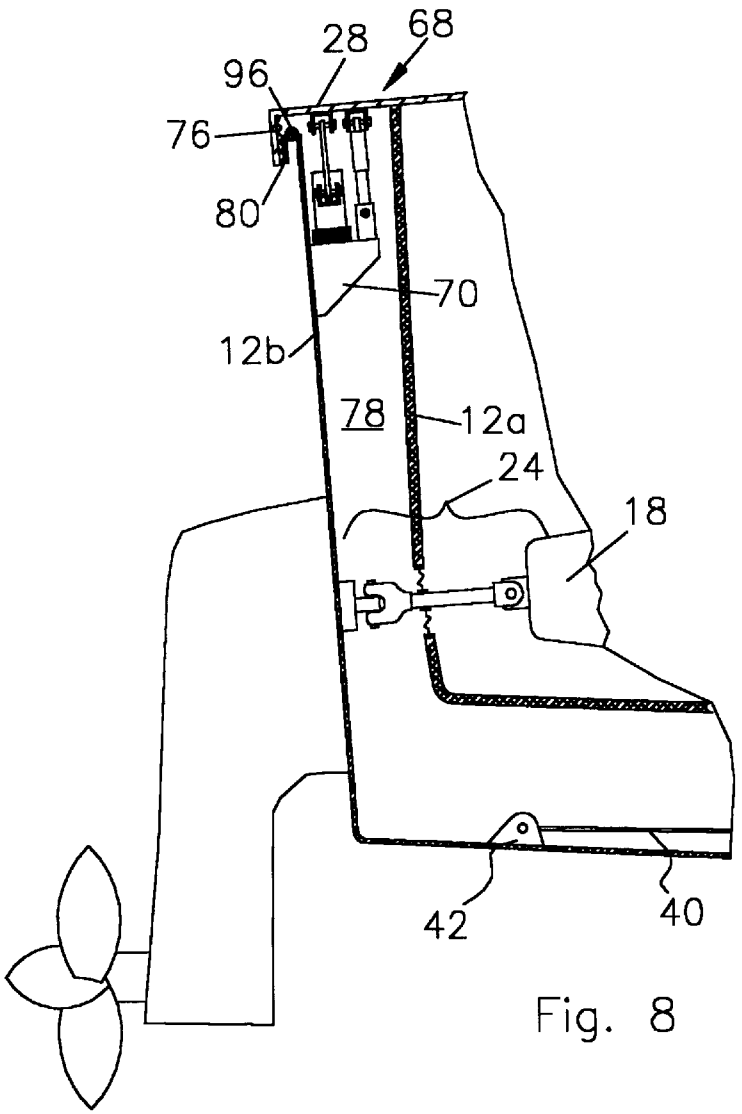
FIG. 8 is a schematic diagram depicting the spring and damper support means located in the stern area of the vessel.

As depicted in FIG. 7, in lieu of having longitudinal pivoted link(s) 40 running in an orientation essentially along the keel line 50 of the vessel 12 between the inner hull 12*a* and the outer hull 12*b*, an alternative configuration is shown wherein two longitudinal pivoted links 40 are pivotally attached so as to form a generally V-shaped configuration. In this configuration, one end of each longitudinal pivoted link 40 is pivotally attached on the inner bottom surface 42 of the outer hull 12*b* generally aft 44 of the vessel 12 and proximate the joinder 56 of the inner sidewall surface 54 of the outer hull 12*b* and the inner bottom surface 42 of the outer hull 12*b*, and generally symmetric to the keel line 50 with each opposite end of the longitudinal pivoted link 40 being pivotally attached at the predetermined location on the outer surface 46 of the inner hull 12*b* generally forward 48 of the vessel 12 proximate the keel line 50 of the vessel 12.

Although the material from which to make the longitudinal pivoted links 40 are not limited to the following, a practical application of material to use includes the use of non-corrosive or corrosive resistant material such as fiber-reinforced composite polymer material, polymeric material, coated steel alloys, non-corrosive metals, graphite composition material and combinations thereof.

A plurality of rubber bumpers 96, each fixed at predetermined locations along the deck flange 32 of the outer hull 12*b*, are included for limiting compression between and preventing direct contact of the superstructure side deck 28 and the outer hull deck flange 32.

Figure 2:
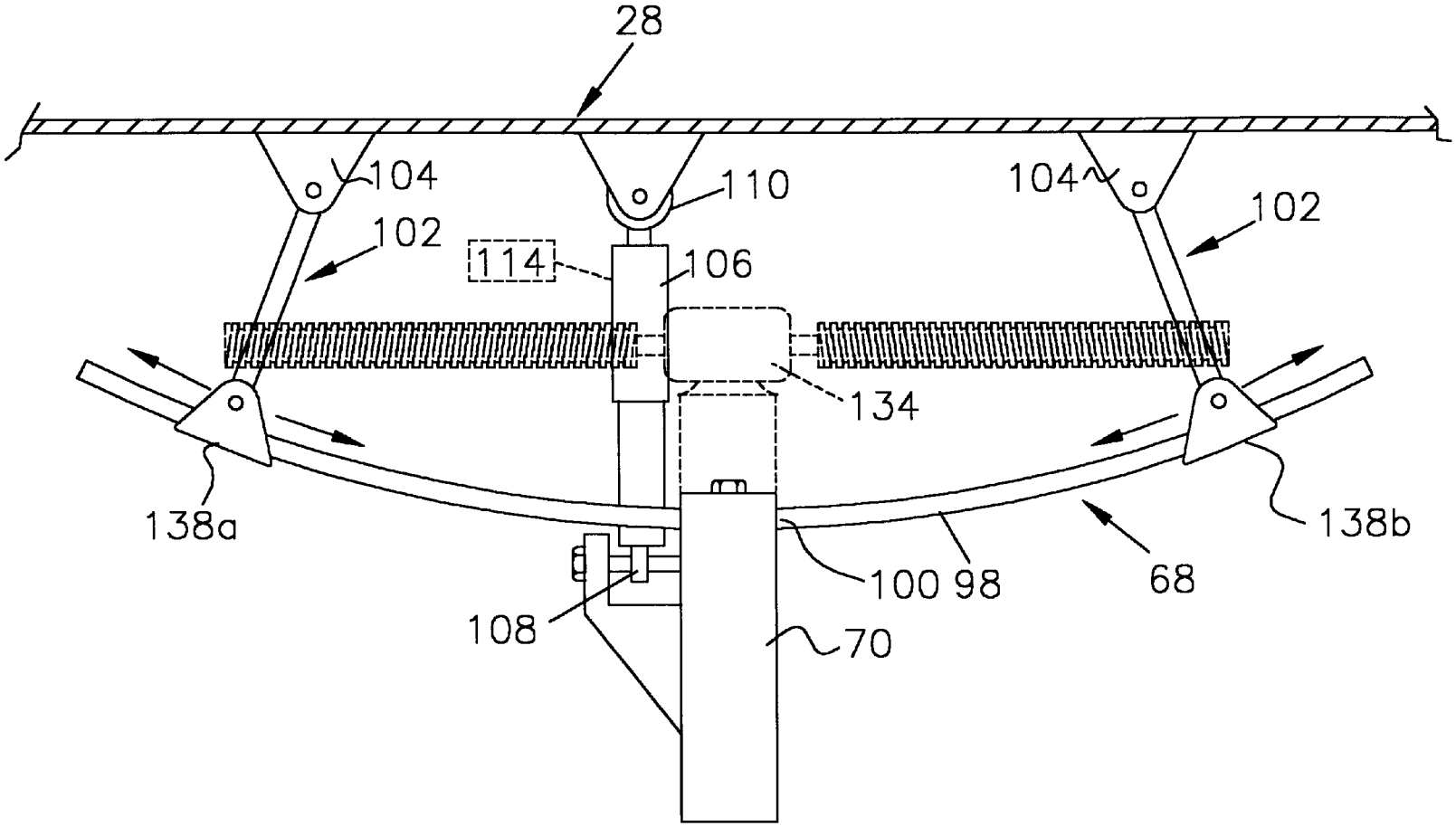
FIG. 2 is a practical application of the a spring and damper support arrangement for the invention.
Figure 3:
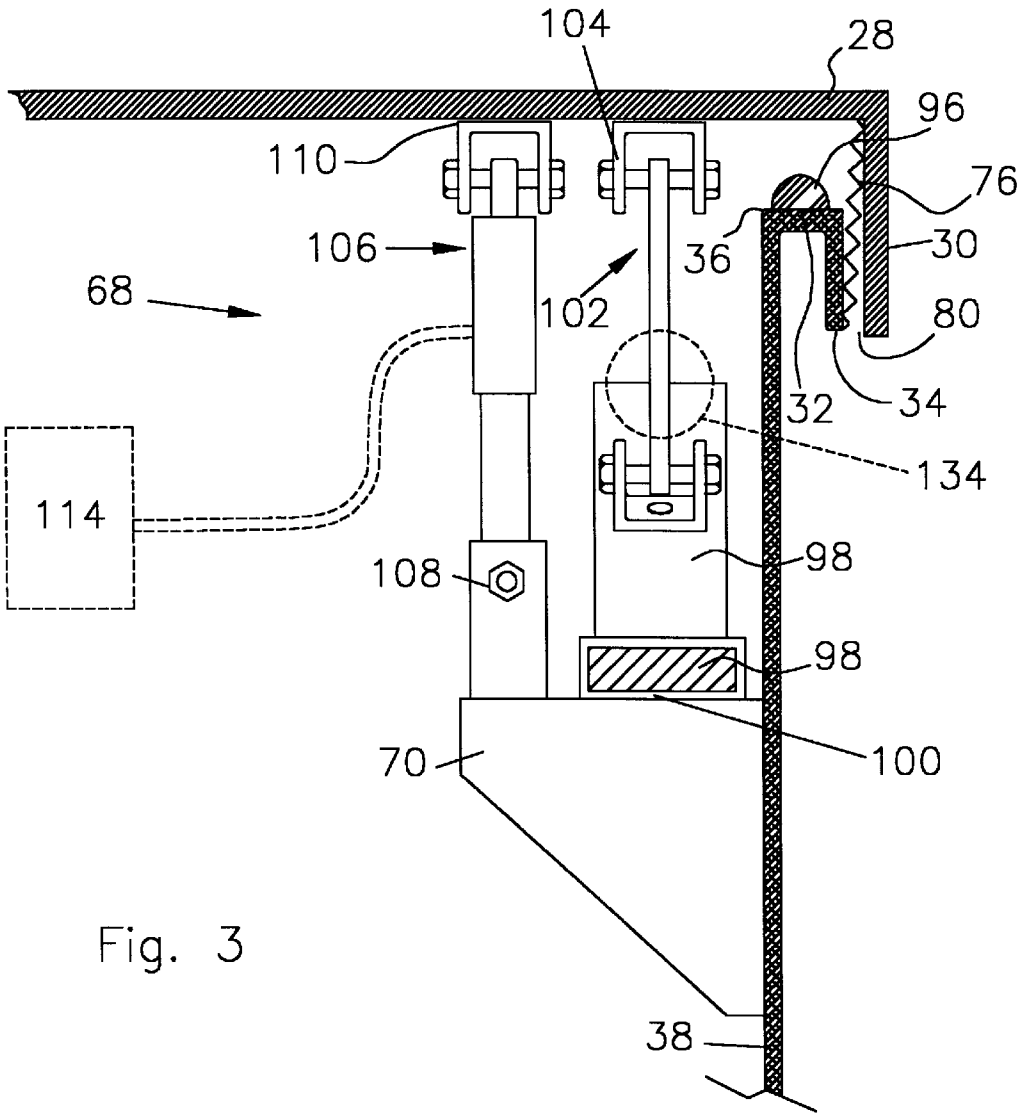
FIG. 3 is a cross-sectional view of the spring and damper support means of FIG. 2.

In the embodiment shown in FIGS. 2, 3. 6, and 8, each spring and damper support means 68 is located between the inner hull 12*a* superstructure side deck 28 and a structural attachment member 70 integrally fixed to and extending from the inner sidewall surface 54 of the outer hull 12*b*. The structural attachment member 70 is typically a bulkhead member or gusset member integrally attached to the outer hull 12*b* with the necessary brackets to attach the spring and damper support means 68 components.

In a practical application of this embodiment, the spring and damper support means 68, included components are a flexible leaf spring member 98 of a predetermined length and oriented generally in the same direction of the side deck 28 above the leaf spring member 98. The leaf spring member 98 is attached at an approximate midpoint 100 to the structural attachment member 70 integrally fixed to and extending from the inner sidewall surface 54 of the outer hull 12*b*. The leaf spring member 98 is also attached to the side deck 28 with two adjustable links 102, each on opposite sides of the midpoint 100 attachment at a point 138*a*,138*b* a predetermined distance from the midpoint 100 attachment. The links 102 are pivotally connected and communicating with an attachment 104 fixed to the side deck 28.

To provide for a dampening effect, damper support means 106 are also included with one end being attached to the structural attachment member 70 fixed to and extending from the inner sidewall surface 54 of the outer hull 12*b* and an opposite end being attached to the side deck 28. There are several methods known in the art regarding the attachment means for the damper support means 106 as well as the leaf spring member 98, including associated brackets and pin connections.

The adjustable links 102 for the leaf spring member 98 may be adjusted for softening or stiffening a vessel ride by changing a rate of response to loads on the outer hull 12*b*. This is typically done by moving the attachment points 138*a*,138*b* on the leaf spring member 98 away or closer to the midpoint 100, as indicated by the directional arrows shown in FIG. 2. Depending on the size of the vessel 12, it may be advantageous to locate at least one of the plurality of spring and damper support means 68 at predetermined locations along the stern 78 of the vessel 12.

Figure 9:
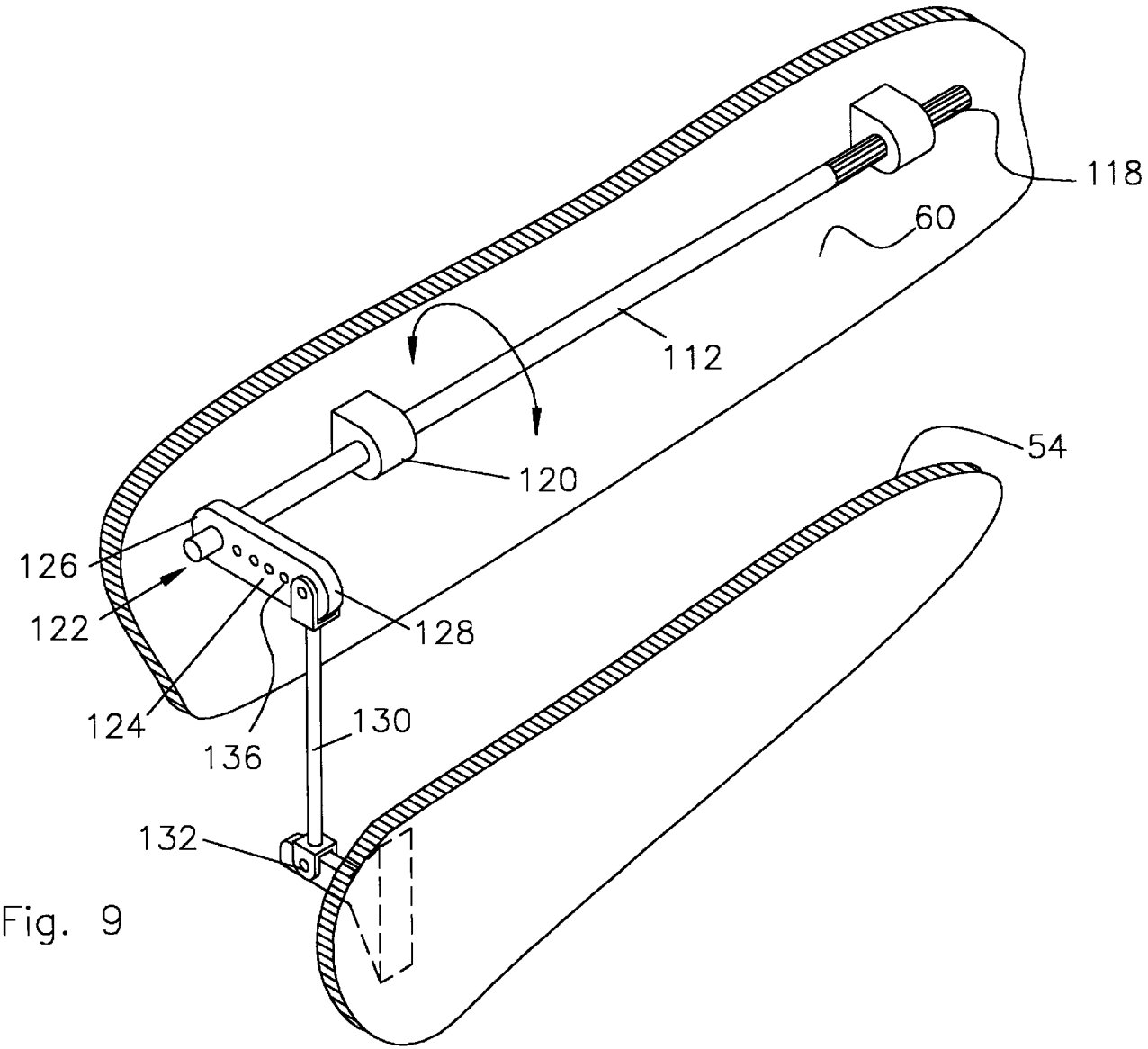
FIG. 9 is a schematic diagram depicting the use of a torsion rod assembly in lieu of a leaf spring for the spring and damper support means.

In lieu of a leaf spring member 98, in another practical application of the invention, a torsion bar assembly may used as schematically depicted in FIG. 9. In this embodiment, the spring and damper support means 68 would include a torsion rod 112. In one embodiment, the torsion rod 112 is fixedly attached at one end 118 to the outer sidewall 60 of the inner hull 12*a*. In addition, the torsion rod 112 has a bearing support 120 at a predetermined distance from an active end 122 of the torsion rod 112. The bearing support 120 is attached to the outer sidewall 60 of the inner hull 12*a* and the torsion rod 112 is aligned generally parallel to the side deck 28. Typically, end 118 of the torsion rod 112 is relatively fixed. This can be done with a spline end within the support at end 118. The bearing support 120 allows the torsion rod 112 to rotate or twist at its active end 122, as shown in FIG. 9.

Figure 10:
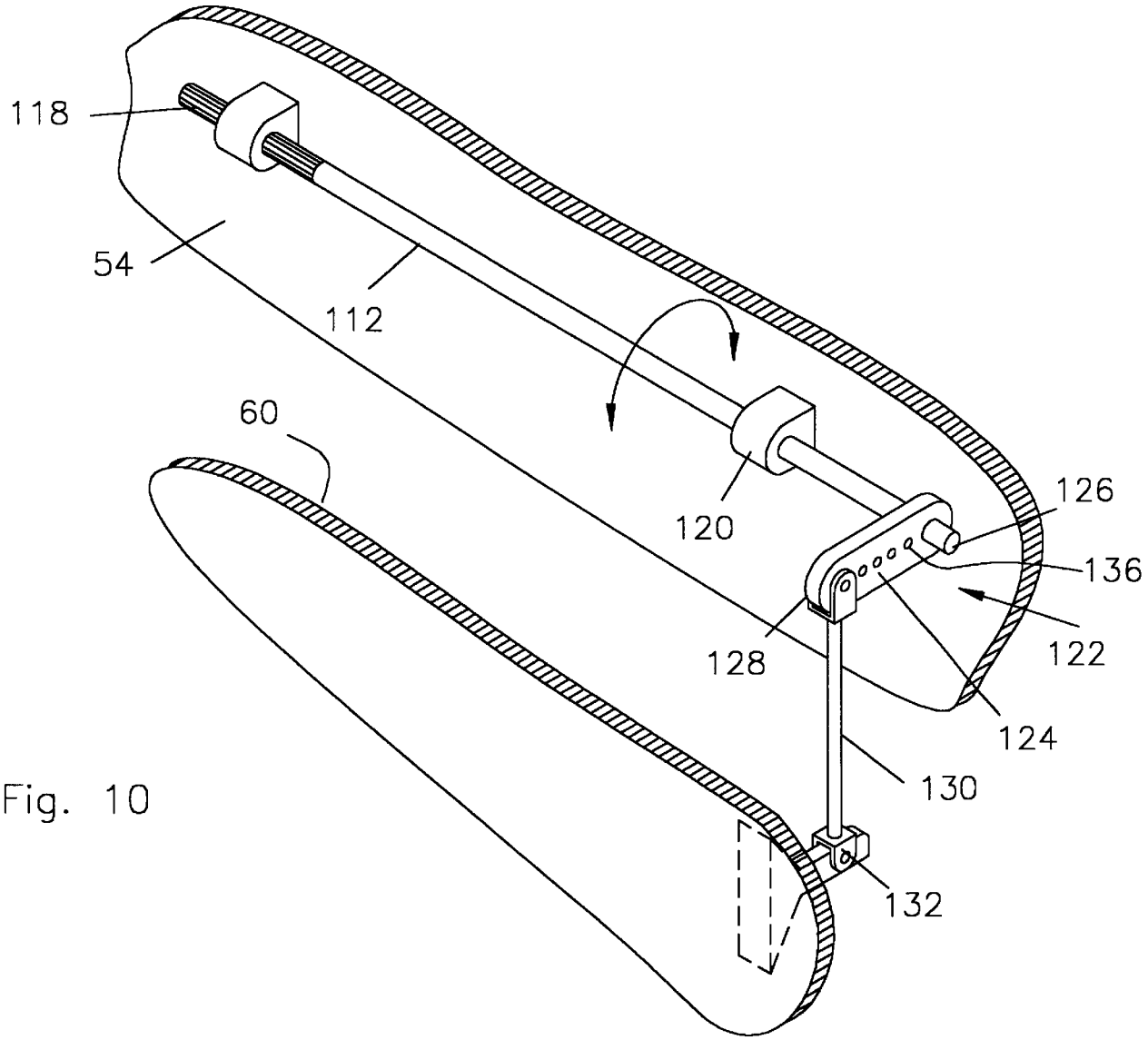
FIG. 10 is a schematic diagram depicting the reverse arrangement of the torsion rod assembly of FIG. 9.

As such, the torsion rod 112 further includes a lever 124, one end 126 of which is fixed to the active end 122. A generally downward directed link 130 is connected at one end to a desired adjusted location at 136 on the lever 124 for providing spring rate adjustment and an opposite end 132 of this link 130 is attached to the inner sidewall surface 54 of the outer hull 12*b*. Of course, the mirror reverse arrangement, as depicted in FIG. 10, is within the realm of this invention where the attachments, that is, the support end 118 and the bearing end 120, for the torsion rod 112 and the downward directed link 130 are reversed so that the torsion rod attachments 118,120 are on the inner sidewall surface 54 of the outer hull 12*b* and the downward link 130 is attached to the outer sidewall surface 60 of the inner hull 12*a*. There also many ways known in the art on how to make the appropriate attachments of the torsion rod assembly components depicted in FIGS. 9 and 10. The methods depicted in the drawings are not intended to be limiting in nature.

Of course, damper support means 106 are preferably used in conjunction with the torsion bar assembly shown in FIG. 9. FIG. 9 does not depict the damper support means 106; however, this element is shown in FIGS. 2 and 3. Typically, one end 108 of the damper support means 106, usually a shock absorber, is attached to the structural attachment member 70 fixed to and extending from the inner sidewall surface 54 of the outer hull 12*b* and an opposite end 110 is attached to the side deck 28. Shock absorbers may incorporate a coil spring over the shock absorbers to provide for augmented springing effects.

In a practical application of the invention, access holes may have to be provided in the inner hull to assist in the installation of the various linkages and damper means described above during the manufacturing process of the vessel 12 or for maintenance purposes. In circumstances where it may not be practical to manually open an access hole, it is anticipated that electronic/mechanical means will be provided to remotely adjust the hardness or softness of the ride.

Further, the damper support means 106 may include electronic/mechanical activation means 114 to provide for an active suspension that responds to loads on the outer hull 12*b*, that is, sensors feeling the impact of the wave shock can automatically respond to the resultant loads. This works well with pneumatically or hydraulically controlled shock absorbers. In addition, the damper support means 106 may also be manually adjusted, including remotely adjusted, to adjust the ride stiffness.

Similarly, each leaf spring member 98 may include electronic/mechanical activation means 134 for selectively adjusting the hardness of the ride by spreading the links 102 toward and away from the proximate midpoint 100 attachment. This may typically be done with appropriate jacks screws and trunnion assemblies operated by electronic controls.

Although several material are suitable for the leaf spring members 98 and its adjustable links 102, the torsion rod 112, lever 124 and link 130, it is recommended that corrosion resistant or non-corrosive materials be used, such as fiber-reinforced composite polymer material, polymeric material, coated steel alloys, non-corrosive metals, graphite composition material and combinations thereof.

In an alternative embodiment to the adjustable links 102 associated with the leaf spring member 98, the links 102 may be coiled springs as well, or combinations thereof.

Active suspensions systems are currently being aggressively developed by the automobile industry. It is within the scope of this invention that the spring and damper support means 68 would include these new systems which electronically reproduce the action of the spring and damper support means 68 as contemplated within the present invention. Certain, torsion rod assemblies, leaf spring and shock absorber assemblies, or combinations of such equipment are currently practical applications of the spring and damper support means 68; however, these newly developed active suspensions systems may also be substituted.

As seen from the foregoing description, the present invention satisfies a long felt need to provide an active suspension system for a high speed vessel, thereby providing a safer environment for boat operators, while minimizing injuries caused by the severe jarring of the impact of high speed boats on the water.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A system for minimizing the effects of shock and vibration in a high speed vessel having a deck, superstructure, ship propulsion machinery, tankage and related equipment, comprising:

a vessel having an inner hull and an outer hull, the inner hull further including the deck and superstructure;

the inner hull superstructure further having a side deck and a downwardly extending outer edge along a perimeter of the superstructure side deck, the side deck and outer edge being in an overlapping relationship with a corresponding deck flange and downwardly extending outer edge along a perimeter of an upper edge of a sidewall of the outer hull;

at least one longitudinal pivoted link, one end of which is pivotally attached at a predetermined location on an inner bottom surface of the outer hull and generally aft of the vessel, an opposite end being pivotally attached at a predetermined location on an outer surface of the inner hull and generally forward of the vessel proximate a keel line of the vessel, the longitudinal pivoted link for constraining the longitudinal motion of the inner hull relative to the outer hull while allowing relative vertical motion;

an aft transverse pivoted link, one end of which pivotally attached generally under the outer bottom surface of the inner hull at a location generally aft of the vessel and proximate a joinder of an inner sidewall surface of the outer hull and the inner bottom surface of the outer hull, an opposite end being pivotally attached at a predetermined location on the outer bottom surface of the inner hull proximate a joinder of an outer sidewall of the inner hull and the bottom surface of the inner hull, the aft transverse pivoted link for constraining the lateral motion of the inner hull relative to the outer hull while allowing relative vertical motion;

a forward end lateral motion limiting means between a bow end of the inner hull and a bow end of the outer hull for providing a lateral motion constraint while allowing relative vertical motion;

a plurality of spring and damper support means between the inner hull and outer hull for cushioning a vertical motion imparted by the outer hull; and each of the plurality of spring and damper support means being located symmetrically at predetermined locations along a port and starboard side of the vessel.

2. The system according to claim 1 further comprising a flexible spray shield for blocking a spray of water from entering between the inner hull and the outer hull through a clearance where the inner hull superstructure side deck and outer edge overlap the corresponding deck flange and outer edge of the outer hull, the spray shield being adapted to maintain a water spray shielding effect during movement corresponding to the relative motion between the inner and outer hulls.

3. The system according to claim 2 wherein the flexible spray shield is made from one of an elastomer material, a polymeric material, and combinations thereof.

4. The system according to claim 1 wherein two longitudinal pivoted links are pivotally attached so as to form a generally V-shaped configuration wherein one end of each longitudinal pivoted link is pivotally attached on the inner bottom surface of the outer hull generally aft of the vessel and proximate the joinder of the inner sidewall surface of the outer hull and the inner bottom surface of the outer hull, and generally symmetric to the keel line with each opposite end of the longitudinal pivoted link being pivotally attached at the predetermined location on the outer surface of the inner hull generally forward of the vessel proximate the keel line of the vessel.

5. The system according to claim 1 wherein the at least one longitudinal pivoted links is made from non-corrosive material comprising fiber-reinforced composite polymer material, polymeric material, coated steel alloys, non-corrosive metals, graphite composition material and combinations thereof.

6. The system according to claim 4 wherein the two longitudinal pivoted links are made from non-corrosive material comprising fiber-reinforced composite polymer material, polymeric material, coated steel alloys, non-corrosive metals, graphite composition material and combinations there.

7. The system according to claim 1 wherein the forward end lateral motion limiting means comprises:

a vertically oriented attachment plate integrally fixed at a predetermined location along a centerline of the bow end of the inner hull, the attachment plate further including a vertically oriented slot extending from a bottom surface of an edge of the attachment plate upwardly a distance corresponding to a predetermined travel limit;

a transverse oriented member symmetrically and integrally fixed at each end thereof to a corresponding location on the inner sidewall surface of the outer hull juxtaposed a centerline of the bow end of the outer hull, the transverse oriented member being aligned to be received within the slot of the attachment plate;

the transverse oriented member further having oversized portions on either side of the slotted attachment plate to further limit the transverse motion of the bow end of the inner hull relative to the bow end of the outer hull; and the oversized portions being made of low friction material.

8. The system according to claim 7 wherein the forward end lateral motion limiting means is made from a non-corrosive material comprising fiber-reinforced composite polymer material, polymeric material, coated steel alloys, non-corrosive metals, graphite composition material and combinations thereof.

9. The system according to claim 2, further including a plurality of rubber bumpers, each fixed at predetermined locations along the deck flange of the outer hull for limiting compression between and preventing direct contact of the superstructure side deck and the outer hull deck flange.

10. The system according to claim 1 wherein each of the plurality of spring and damper support means is located between the inner hull superstructure side deck and a structural attachment member integrally fixed to and extending from the inner sidewall surface of the outer hull.

11. The system according to claim 10, wherein each of the plurality of spring and damper support means includes:

a flexible leaf spring member of a predetermined length and oriented generally in the same direction of the side deck above said leaf spring member, the leaf spring member being attached at an approximate midpoint to the structural attachment member integrally fixed to and extending from the inner sidewall surface of the outer hull;

the leaf spring member further being attached to the side deck with two adjustable links, each on opposite sides of the midpoint attachment at a point a predetermined distance from the midpoint attachment, the links further being pivotally connected and communicating with an attachment fixed to the side deck; and damper support means, one end being attached to the structural attachment member fixed to and extending from the inner sidewall surface of the outer hull and an opposite end being attached to the side deck, wherein the adjustable links for the leaf spring member may be adjusted for softening or stiffening a vessel ride by changing a rate of response to loads on the outer hull.

12. The system according to claim 11, wherein at least one of the plurality of spring and damper support means are further located at predetermined locations along the stern of the vessel.

13. The system according to claim 1, wherein each spring and damper support means includes:

a torsion rod, the torsion rod being fixedly attached at one end to the outer sidewall of the inner hull, the torsion rod having a bearing support at a predetermined distance from an active end of the torsion rod, the bearing support being attached to the outer sidewall of the inner hull and the torsion rod being aligned generally parallel to the side deck;

the torsion rod further including an adjustable lever, one end of which is fixed to the active end;

a generally downward directed link, the link being connected at one end to a desired adjusted location on the lever for providing spring rate adjustment, and an opposite end of said link further being attached to the inner sidewall surface of the outer hull; and damper support means, one end of the damper support means being attached to the structural attachment member fixed to and extending from the inner sidewall surface of the outer hull and an opposite end being attached to the side deck, wherein the torsion rod and damper means are adjustable for softening or stiffening a vessel ride by changing a rate of response to loads on the outer hull.

14. The system according to claim 11, wherein the damper support means is a shock absorber.

15. The system according to claim 13, wherein the damper support means is a shock absorber.

16. The system according to claim 13, wherein at least one of the plurality of spring and damper means are further located at predetermined locations along the stern of the vessel.

17. The system according to claim 11, wherein the damper support means includes electronic/mechanical activation means to provide for an active suspension that responds to loads on the outer hull.

18. The system according to claim 13, wherein the damper means includes electronic/mechanical activation means to provide for an active suspension that responds to loads on the outer hull.

19. The system according to claim 11, wherein the leaf spring members and the adjustable links are made of non-corrosive material comprising fiber-reinforced composite polymer material, polymeric material, coated steel alloys, non-corrosive metals, graphite composition material and combinations thereof.

20. The system according to claim 13, wherein the torsion rod, lever and link are made of non-corrosive material comprising fiber-reinforced composite polymer material, polymeric material, coated steel alloys, non-corrosive metals, graphite composition material and combinations thereof.

21. The system according to claim 7, wherein the oversized portions are rolling devices.

22. The system according to claim 7, wherein the oversized portions are integral extended portions of the transverse oriented member.

23. The system according to claim 21, wherein the rolling devices are one of ball bearings or wheels.

24. The system according to claim 11, wherein the adjustable links are springs.

25. The system according to claim 1, wherein the inner hull is watertight.

26. The system according to claim 11, wherein each leaf spring member further includes electronic/mechanical activation means for selectively adjusting the hardness of the ride by spreading the links toward and away from the proximate midpoint attachment.

27. The system according to claim 13, wherein the attachments for the torsion rod and the downward directed link are reversed so that the torsion rod attachments are on the inner sidewall surface of the outer hull and the downward link is attached to the outer sidewall surface of the inner hull.

28. The system according to claim 11, wherein the damper support means includes electronic/mechanical activation means for remotely adjusting the hardness of the ride.

29. The system according to claim 13, wherein the damper support means includes electronic/mechanical activation means for remotely adjusting the hardness of the ride.

30. The system according to claim 1, wherein the outer hull is watertight.

* * * * *